US005779371A

United States Patent [19]

Aoyama et al.

[11] Patent Number: 5,779,371

[45] Date of Patent: Jul. 14, 1998

[54] THERMAL PRINTING APPARATUS

[75] Inventors: Yuji Aoyama, Sagamihara; Masao Yamada, Zama, both of Japan

[73] Assignee: Anritsu Corporation, Tokyo, Japan

[21] Appl. No.: 713,732

[22] Filed: Sep. 13, 1996

[30] Foreign Application Priority Data

Sep. 29, 1995 [JP] Japan ..... 7-253339

[51] Int. Cl.[6] ..... B41J 2/32

[52] U.S. Cl. ..... 400/120.16; 347/197

[58] Field of Search ..... 400/120, 120 HE, 400/120.16, 120.17, 690.4, 692; 347/197, 198; 346/145

[56] References Cited

U.S. PATENT DOCUMENTS

| | | | |
|---|---|---|---|
| 3,967,092 | 6/1976 | Conta et al. . | |
| 4,055,743 | 10/1977 | Conta et al. . | |
| 4,130,752 | 12/1978 | Conta et al. . | |
| 4,830,523 | 5/1989 | Sparer et al. | 400/120.16 |
| 4,896,166 | 1/1990 | Barker et al. . | |
| 4,947,185 | 8/1990 | Mitsushima et al. . | |
| 5,051,009 | 9/1991 | Sugiura et al. | 400/120.16 |
| 5,055,858 | 10/1991 | Koch | 347/197 |
| 5,092,693 | 3/1992 | Uchimura | 400/175 |
| 5,106,215 | 4/1992 | Kitahara et al. | 400/120.16 |
| 5,122,073 | 6/1992 | Del Signore, II et al. | 400/692 |
| 5,248,207 | 9/1993 | Yamamoto et al. | 400/208 |
| 5,366,302 | 11/1994 | Masumura et al. | 400/120.16 |
| 5,565,905 | 10/1996 | Kajiya et al. | 347/197 |

FOREIGN PATENT DOCUMENTS

| | | | |
|---|---|---|---|
| 0348176 A2 | 12/1989 | European Pat. Off. . | |
| 0430565 A2 | 6/1991 | European Pat. Off. . | |
| 2484916 | 12/1981 | France . | |
| 58-14777 | 1/1983 | Japan . | |
| 61-132362 | 6/1986 | Japan | 400/120 HE |
| 63-059572 | 3/1988 | Japan | 400/120 HE |
| 3-092374 | 4/1991 | Japan | 347/197 |
| 3-35111 | 5/1991 | Japan . | |

*Primary Examiner*—David A. Wiecking

*Attorney, Agent, or Firm*—Frishauf, Holtz, Goodman, Langer & Chick

[57] ABSTRACT

A thermal printing apparatus has a housing divided into two sections, a main shell and a cover which are joined at one end to each other for opening and closing, for ease of the mounting, dismounting, and positioning of a thermal head with a pair of connectors without the use of any conventional tool. A platen is pivotably mounted to the cover. The thermal head includes a head side connector and a heating element mounted on one side of a rectangular base thereof for printing on labels. A head frame is provided having positioning members for determining the position of the thermal head to the platen when the housing is closed and positioning projections for coming into direct contact with four sides of the base to hold the thermal head in its position, and mounted to a base frame in the main shell. A circuit side connector is movably mounted to the head frame for fine positional adjustment to the head side connector.

15 Claims, 6 Drawing Sheets

THERMAL PRINTING APPARATUS

BACKGROUND OF THE INVENTION

1. Field of the Invention

The present invention generally relates to a thermal printing apparatus and more particularly, to a thermal printing apparatus of a type having a thermal head supporting construction, such as a label printer for printing desired sets of characters with a thermal head on a succession of labels attached at intervals of a given distance on a label base sheet.

2. Description of the Related Art

Label printer thermal printing apparatuses with thermal heads are well known for use in printing various information including product name, lot number, barcode, destination, and dispatcher on a succession of blank labels bonded and aligned at intervals of a given distance on a label base tape.

The label printer includes a thermal head at a printing position disposed with its heating element opposite to and in pressure contact with a platen. While the label tape carrying a row of the labels thereon is fed through between the thermal head and the platen, desired sets of characters are thermally printed on the labels by the action of the heating element of the thermal head.

It is essential for the label printer of this type to locate the thermal head and the platen at the relative positions with accuracy. If the positional relationship between the thermal head and the platen is not favorable, the printed characters on the labels may appear less legible.

A thermal head supporting construction or mechanism for adjusting the position of a thermal head has been proposed as disclosed in Japanese Patent Application KOKOKU Publication No.3-35111(1991) (Japanese Patent Application KOKAI Publication No.62-152882(1987)).

The mechanism for adjusting the position of a thermal head comprises, as shown in FIG. 6, a head supporting frame 101 supporting a thermal head 100, a movable intermediate plate 102 movably provided between the thermal head 100 and the head supporting frame 101, a platen 103 pivotably mounted to a housing frame, not shown, and aligned directly with the printing position of the thermal head 100, and a thermal head positioning member 104 mounted integral with the movable intermediate plate 102 for adjusting the printing position of the thermal head 100 to directly align with the platen 103.

The head supporting frame 101 has two thread apertures 105 provided therein at both ends depthwisely of the plane of FIG. 6, and is pivotably supported at one end by a pivot 106 for opening upwardly of the unshown housing in the direction denoted by the arrow in FIG. 6 and remains urged at the other end by a resilient member 107 such as a spring.

The movable intermediate plate 102 between the thermal head 100 and the head supporting frame 101 is adapted for movement in parallel to and along the lower surface 100*a* of the head supporting frame 101 and has a slot 108 therein extending along the center line across the two thread apertures 105.

A flanged support 109 is placed in the slot 108 as tightened by screws 110 screwed into their respective thread apertures 105 of the head supporting frame 101.

The thermal head 100 is tightened by flat-top screws 111 to the lower surface of the movable intermediate plate 102 so that it can move forward and backward together with the movable intermediate plate 102.

The thermal head 100 is connected at its back to a head connector 112 which supplies a control signal for activating the thermal head 100.

The head connector 112 extends upwardly across through openings 113 and 114 provided in the movable intermediate plate 102 and the head supporting frame 101 respectively to out of the back side of the head supporting frame 101.

The head connector 112 is also coupled at the other end to a PC board connector 116 which is connected by a lead line 115 such as a flat cable to a PC board on the unshown housing frame to which the platen 103 is pivotably mounted.

The thermal head positioning member 104 on the movable intermediate plate 102 has two U shaped notches 117 provided in both sides thereof.

The U shaped notches 117 of the thermal head positioning member 104 are engaged with bearings 118 mounted on a platen shaft 103*a* of the platen 103.

The thermal head position adjusting mechanism is designed so that the printing position of the thermal head 100 is aligned with the center line across the U shaped notches 117 of the thermal head positioning member 104.

In case that the platen 103 is displaced horizontally due to dimensional errors of a component or vibration of a drive source, the thermal head positioning member 104 allows the thermal head 100 to move and align with the normal of the platen 103. More specifically, any displacement caused by vibration or other error is offset by positioning the printing position of the thermal head 100 for alignment with the platen 103.

For removing the thermal head 100 from the head supporting frame 101 in the thermal head position adjusting mechanism, the platen 103 is disengaged from the U shaped notches 117 of the thermal head positioning member 104 after the housing is opened at the thermal head side. Then, when t he screw 110 has been loosened and removed, the movable intermediate plate 102 with the thermal head 100 is released from the head supporting frame 101.

The thermal head 100 is pulled out with the head side connector 112 and the printed circuit board side connector 116 thereon and detached from the movable intermediate plate 102 by loosening and removing the flat-top screws 111.

The head side connector 112 and the printed circuit board side connector 116 are disconnected from the thermal head 100.

Mounting the thermal head 100 to the head supporting frame 101 follows a reverse of the above procedure.

It is necessary for the thermal head position adjusting mechanism to ensure a substantial length of the lead line 115 with the two connectors 112 and 116 for allowing the thermal head 100 on the movable intermediate plate 102 to be untightened and withdrawn from the head supporting frame 101 before being disconnected from the connectors 112 and 116.

The length of the lead line 115 requires a considerable size of space for installation in the housing and may disturb and damage other adjacent components during the mounting and dismounting of the thermal head 100.

It is thus understood that a particular tool may be desired by a common operator for ease of servicing the thermal head position adjusting mechanism of the thermal printing apparatus disclosed in Japanese Patent Application KOKOKU Publication No.3-35111(1991) (Japanese Patent Application KOKAI Publication No.62-152882(1987)) as the mounting and dismounting of the thermal head 100 are troublesome due to the two connectors 112 and 116 to be connected and disconnected.

SUMMARY OF THE INVENTION

It is therefore an object of the present invention to provide a new and improved thermal printing apparatus in which the mounting and dismounting of a thermal head are facilitated with relevant connectors to be connected and disconnected.

According to an aspect of the present invention, there is provided a thermal printing apparatus comprising: a main shell; a frame arranged movable in upper and lower directions for opening and closing the main shell; a thermal head for printing on a printing medium, the thermal head including: (a) a heat radiator plate; (b) a printed circuit board mounted on an upper surface of the head radiator plate; (c) a heating element mounted on an upper surface of the printed circuit board and located on a location having a predetermined positioning relationship to the heat radiator plate; and (d) a first connector provided on the printed circuit board with vertical connecting directions; a platen pivotably mounted to the frame for nipping the printing medium between the platen and the thermal head; first positioning means provided on the frame coaxially of the platen; a thermal head mount having second positioning means for laterally positioning the heat radiator plate and third positioning means arranged laterally movable to the main shell for fixing a horizontal position of the thermal head while engaging with the first positioning means when the frame is lowered to close the main shell, thereby detachably supporting the thermal head; and a second connector mounted on the thermal head mount for detachably connecting to the first connector with the vertical connecting directions while the thermal head being installed on the thermal head mount.

Additional objects and advantages of the present invention will be set forth in the description which follows, and in part will be obvious from the description, or may be learned by practice of the present invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the present invention.

DETAILED DESCRIPTION OF THE PREFERRED EMBODIMENTS

Figure 1:
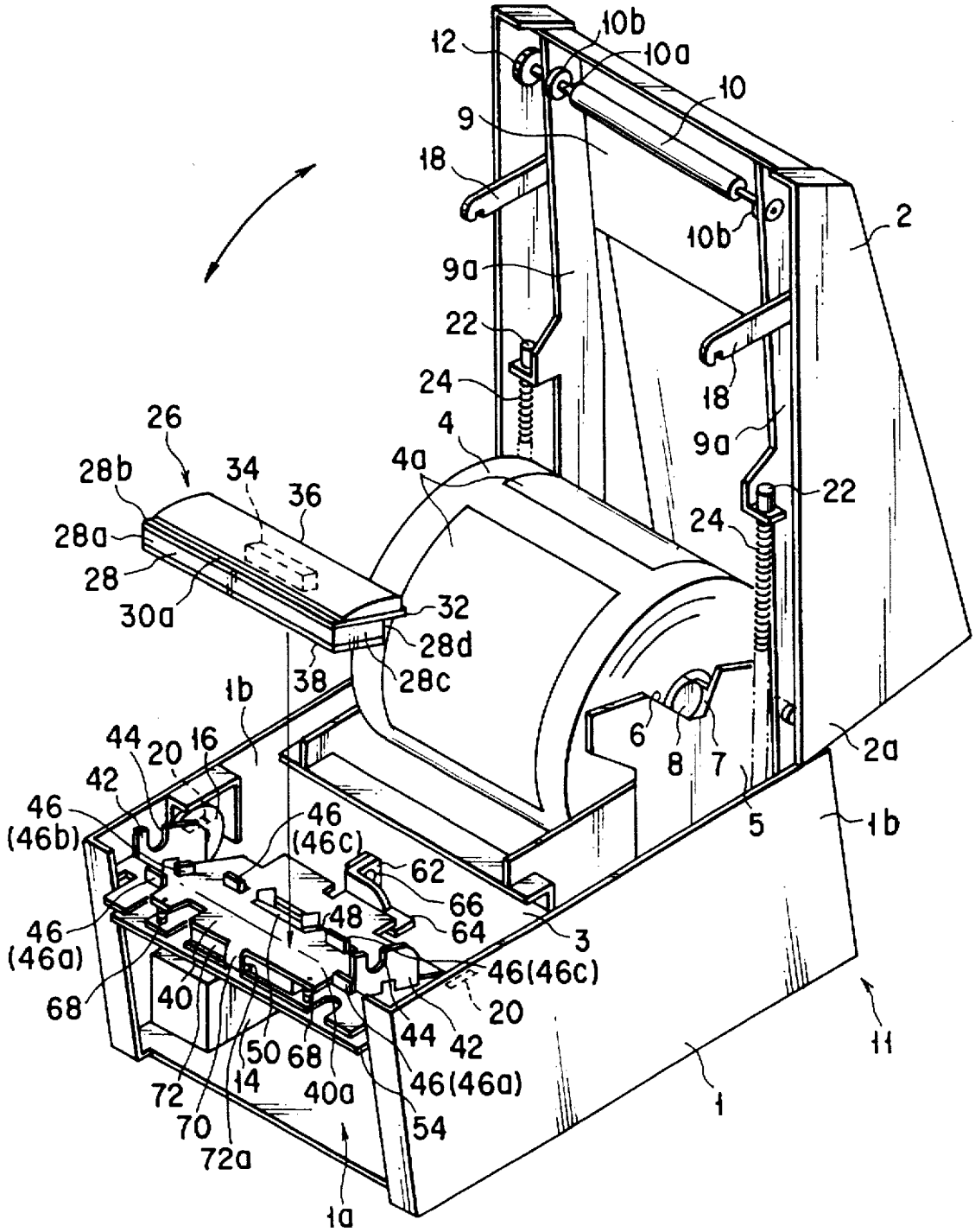
FIG. 1 is a perspective view of the entire construction of a label printer showing an embodiment of a thermal printing apparatus of the present invention.

Reference will now be made in detail to the presently preferred embodiments of the invention as illustrated in the accompanying drawings, in which like reference characters designate like or corresponding parts throughout the several drawings.

For achievement of the foregoing object of the present invention, a thermal printing apparatus is provided, as shown in FIG. 1, with a housing 11 including two, first and second, shells 1 and 2 joined at one end to each other, a platen 10 pivotably mounted on the second shell 2, a thermal head 26 having a heating element 30*a* disposed on one side of a rectangular base 28 for printing on a printing medium 4a and a head side connector 34 detachably joined a right angle to a plane of the heating element 30*a*, positioning members 42 for positioning in relation to the platen 10 in the closed state of the housing 11, a thermal head mount 40 having projections 46*a*, 46*b*, and 46*c* which come into direct contact with four sides 28*a*, 28*b*, 28*c*, and 28*d* of the base 28 for positioning the thermal head 26 and movably mounted to the first shell 1, and a circuit side connector 50 mounted on the thermal head mount 40 for fine displacement.

The thermal printing apparatus of the present invention also includes a magnetic member 38 mounted opposite to the heating element 30*a* on the base 28 for attaching the base 28 to the first shell denoted by the reference numeral 1.

The thermal head mount 40 is mounted at a center of one end by a shaft to the first shell 1 and is urged at both sides of the other end by urging means 68 so that the heating element 30*a* is pressed against the platen 10. Disposed between the thermal head mount 40 and the first shell 1 are two stoppers 70 and 72 for restricting the movement of the thermal head mount 40 urged by the urging means 68 towards the platen 10.

The thermal head 26 is located on the thermal head mount 40 with its projections 46*a*, 46*b*, and 46*c* aligned with the four sides 28*a*, 28*b*, 28*c*, and 28*d* of the base 28 while the housing 11 is being opened.

As the four sides 28*a*, 28*b*, 28*c*, and 28*d* of the base 28 are in direct contact with the projections 46*a*, 46*b*, and 46*c*, the magnetic member 38 of the thermal head 26 attracts the surface of the thermal head mount 40 so that the thermal head 26 is positioned without any displacement in left, right, front, and rear directions on the thermal head mount 40.

While the thermal head 26 is located directly on the thermal head mount 40, its head connector 34 is inserted into the circuit side connector 50 for close connection.

When the housing 11 is closed, the platen 10 in the second shell 2 presses against the surface of the heating element 30*a* of the thermal head 26, and its bearings 10*b* come into engagement with positioning notches 44 provided in the positioning members 42 of the thermal head mount 40 to determine the positioning of the platen 10 to the thermal head 26.

The heating element 30*a* of the thermal head 26 is thus pressed against the platen 10 by the urging means 68 on the thermal head mount 40 so that a printing medium such as a label base sheet carrying labels is nipped between the heating element 30*a* and the platen 10.

For dismounting the thermal head 26 from the thermal head mount 40, the housing 11 is opened to release the platen 10 from the positioning members 42 and the thermal head 26 is removed from its mount 40.

In other words, the attachment of the base 28 to the thermal head mount 40 by the action of the magnetic member 38 is released.

As the thermal head 26 is removed, the head connector 34 is disconnected from the circuit side connector 50.

At that time, the thermal head mount 40 kept urged by the urging means 68 towards the platen 10 is prevented from further lifting by the stoppers 70 and 72 interposed between the thermal head mount 40 and the first shell 1.

The embodiment of the present invention will now be described in more detail. Referring to FIG. 1, the thermal printing apparatus is disclosed in the form of a label printer with a thermal head including the housing 11 of two shells; an upper one or cover (the second shell 2) is openably joined to a lower one or housing body (the first shell 1) of a box shape.

The housing body 1 has an opening la provided in both upper and front sides thereof. A base frame 3 of a sheet extends horizontally across the opening 1*a*.

Two supports 5 (shown one in FIG. 1) are mounted in the rear of and on both sides of the base frame 3 for supporting a roll of label base tape 4 on which printing mediums or labels 4*a* are attached in a row.

The support 5 has a notch 6 of trapezoid shape provided in a top center thereof.

A shaft support extension 7 is provided integral with the support 5 beside the notch 6 extending inwardly at a right angle from the support 5.

The shaft support extensions 7 support in a combination the lower half of a supply shaft 8 extending across the center of the roll of the label tape 4.

There is a cover frame 9 of a channel shape fixedly mounted to the inner surface of the cover 2 and having two side arms 9*a* for clearing a lower region of the roll of the label tape 4.

The cover 2 is openable on the housing body 1 with its proximal end 2*a* pivotably joined by the side arms 9*a* of the cover frame 9 to the supports 5 so that it can move in two directions denoted by the arrow in FIG. 1 for opening and closing the opening 1*a* of the housing body 1.

The platen 10 of a roller is mounted by a shaft 10a to the distal ends of the side arms 9*a* of the cover frame 9.

The shaft 10*a* of the platen 10 is fixedly joined at one end to a drive gear 12 located outside one of the side arms 9*a* of the cover frame 9.

The drive gear 12, when the cover 2 is closed, meshes with a transmission gear 16 linked to the drive shaft of a motor 14 in the housing body 1.

The platen 10 is rotated by a driving force of the motor 14 transmitted through the transmission gear 16 and the drive gear 12.

An open/closing lever 18 of a channel shape is mounted to each of the side arms 9*a* of the cover frame 9 so that it can be turned by an operating bar, not shown, provided on the outer surface of the cover 2.

When the cover 9 is closed, the open/closing levers 18 come into engagement with notches 20 provided on both sides of the base frame 3 in the housing body 1.

Upon the operating bar (not shown) being turned for shifting the cover 2 from its closing state to opening state, the open/closing levers 18 are disengaged from their respective notches 20.

Two support arms 22 are provided between the side arms 9*a* of the cover frame 9 and side walls 1*b* of the housing body 1 for holding the cover 2 to the housing body 1.

The support arm 22 has an urging means 24 such as a coil spring fitted therein for urging the cover 2 in its open direction.

The rectangular base 28 of the thermal head 26 for printing on the labels 4*a* of the label tape 4 has the four sides 20*a*, 28*b*, 28*c*, and 28*d* assigned to be reference faces for correct positioning.

Figure 5A:
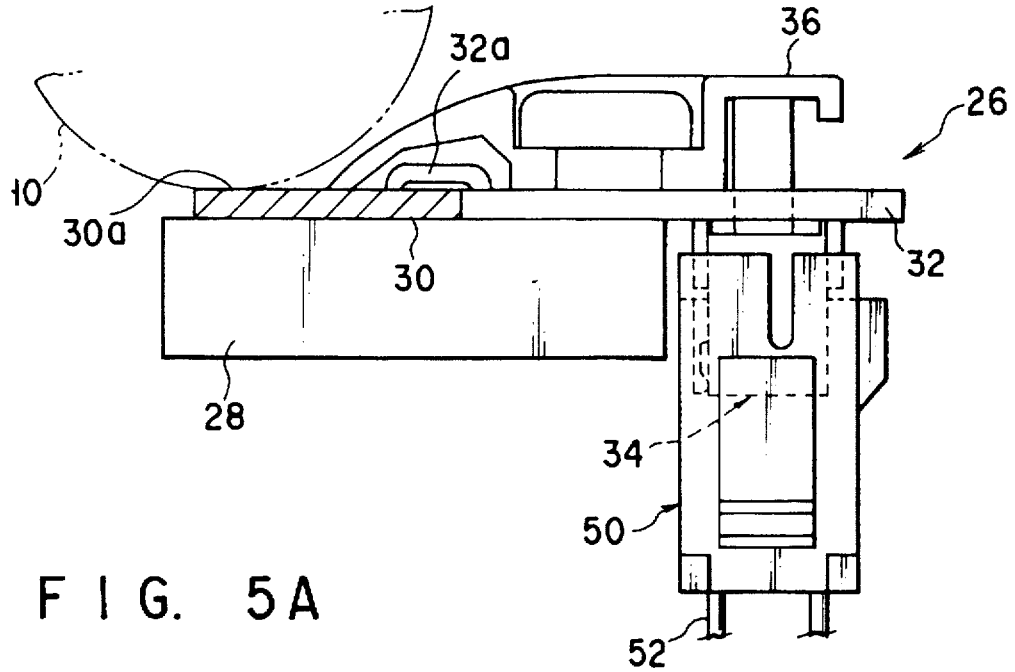
FIGS. 5A, 5B, and 5C are views showing the thermal head of FIG. 1, a head connector, and a circuit connector respectively shown in FIGS. 3 and 4.

As best shown in FIG. 5A, the heating element 30a of a belt shape for printing on the labels 4*a* as the label tape 4 being advanced is seated on a ceramic substrate 30 which is adhesively arranged next to a circuit board 32 on the base 28. The circuit board 32 includes an IC circuit 32*a* for activating the heating element 30*a*.

The base 28 may be made of a metallic material such as aluminum for releasing heat generated by the heating element 30*a* towards the thermal head mount or head frame 40 which will be described hereinbelow in more detail.

The circuit board 32 extends at one end outward from the rear side 28*d* of the base 28.

Figure 5B:
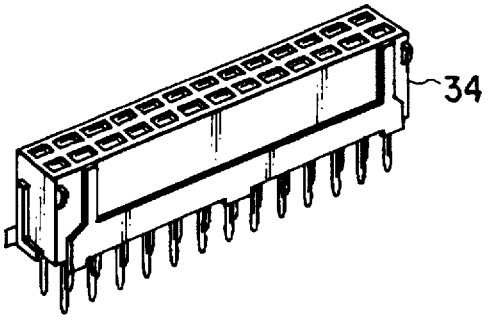

The head side connector 34, shown in FIG. 5B, for supplying a control signal to the thermal head 26 is fixedly mounted to a center region of the lower surface of the outwardly extended portion of the circuit board 32.

Also, a cover member 36 is provided over the circuit board 32 for protecting the upper surface of the circuit board 32.

The magnetic member 38 such as a sheet of magnet is bonded by adhesive to the entire lower surface of the base 28.

The magnetic member 38 holds the thermal head 26 in a given place by magnetic attraction on the head frame 40 which will be described later.

The magnetic member 38 may be bonded to a part but not entire surface of the base 28 or may not be provided.

The head frame 40 is made of a metallic, magnetic material, mounted to the front end of the base frame 3, and arranged movable forward and backward for positioning the thermal head 26.

A central region of the head frame 40 is tilted down at a predetermined angle from front to rear, constituting a mount surface 40*a* on which the thermal head 26 is mounted.

The positioning members 42 are provided integral with the head frame 40 for determining the front and rear position of the platen 10, extending upward at a right angle from both sides of the head frame 40.

U shaped notches 44 provided in the top of the positioning members 42 are formed perpendicular to the mount surface 40*a*.

This allows the optimum positioning relationship for printing to the heating element 30*a* of the thermal head 26 positioninged on the head frame 40 and the platen 10 when the bearings 10*b* of the platen 10 are engaged with the U shaped notches 44 of the positioning members 42.

With its bearings 10*b* engaged with their respective U shaped notches 44, the platen 10 is positioned on the head frame 40 as restrained in both the front and rear directions.

Figure 2:
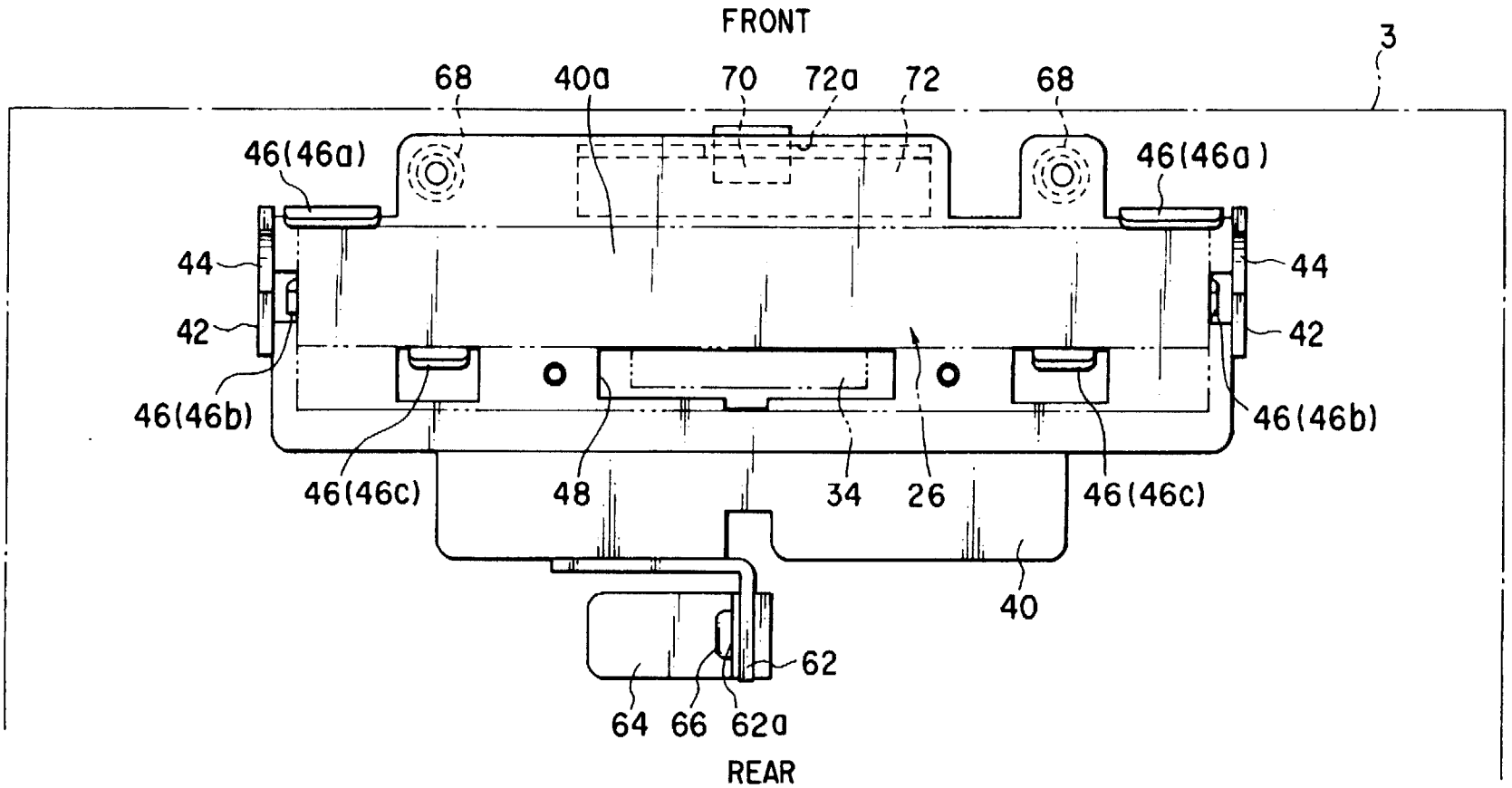
FIG. 2 is an enlarged plan view showing a head frame region of FIG. 1.

As shown in FIG. 2, the projections 46 formed integrally with the head frame 40 are arranged for holding the fours sides 28*a*, 28*b*, 28*c*, and 28*d* of the base 28 of the thermal head 26 at six different locations.

More particularly, the projection 46*a* is provided for positioning the front side 28*a* of the base 28 and formed by bending a tab portion at each end of the head frame 40, two at both ends, at a right angle thus to stand upright on the mount surface 40*a*.

Similarly, the projections 46*b* and 46*c* provided for positioning the two sides 28*b* and 28*c* and rear side 28*d* of the base 28 are formed by bending tab portions, two for each defined by channel shaped cutouts, of the head frame 40 at a right angle thus to stand upright on the mount surface 40*a*.

Accordingly, the thermal head 26 is precisely positioned on the head frame 40 with the four sides 28*a*, 28*b*, 28*c*, and 28*d* of its base 28 directly held by the inner surfaces of the projections 46*a*, 46*b*, and 46*c* and restrained in the four, left, right, front, and rear, directions.

As the thermal head 26 is precisely positioned on the head frame 40 with the four sides 28*a*, 28*b*, 28*c*, and 28*d* of its base 28 directly held by the projections 46*a*, 46*b*, and 46*c*, the magnetic member 38 on the base 28 tightly holds the head frame 40 by its attraction.

Therefore, the relative positioning relationship between the thermal head 26 and the platen 10 is determined in relation to the base 28, the head frame 40 and the bearings 10*b*.

The head frame 40 has a rectangular opening 48 in the center thereof.

Figure 3:
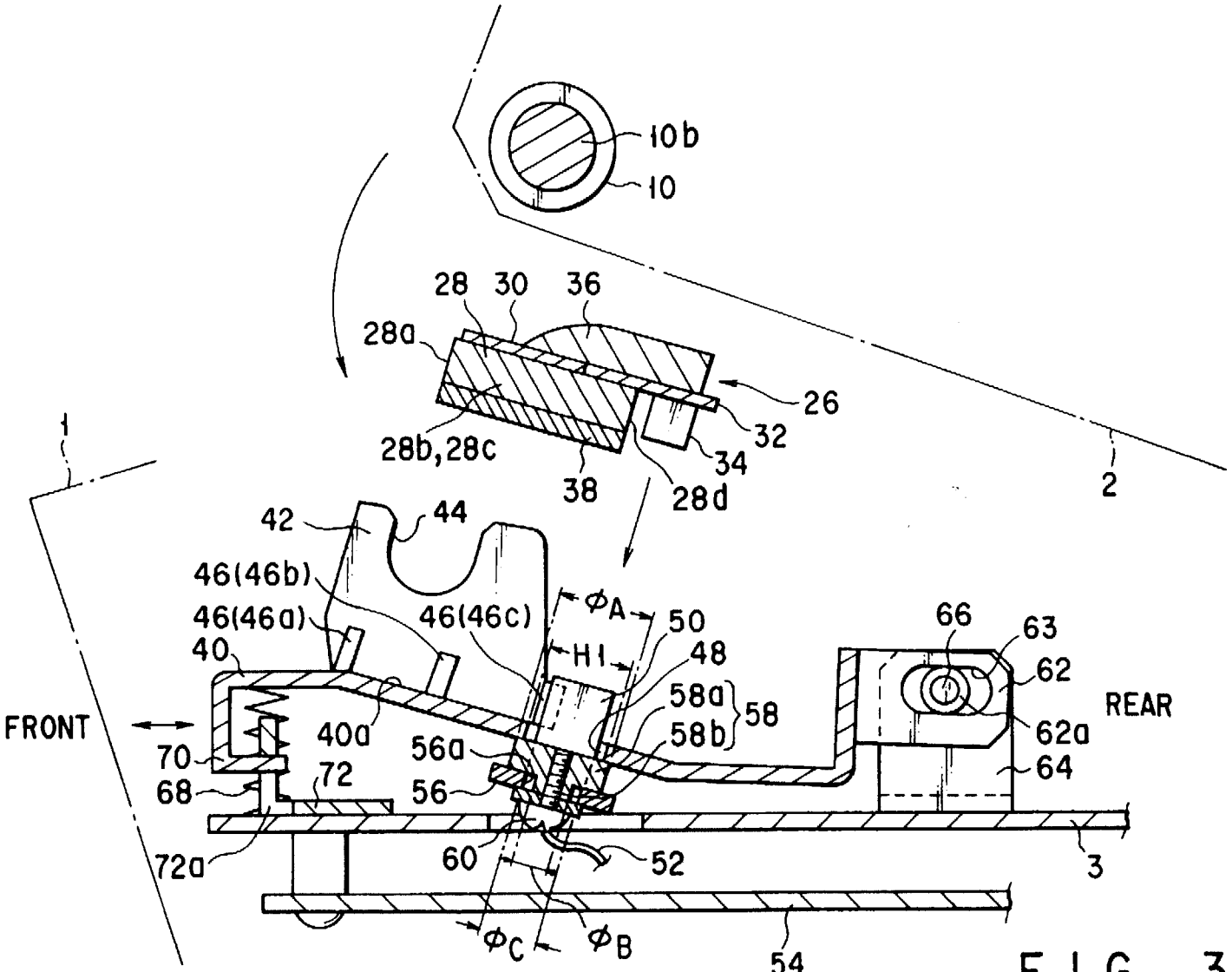
FIG. 3 is a partially enlarged cross sectional view with a cover opened and a thermal head removed.
Figure 4:
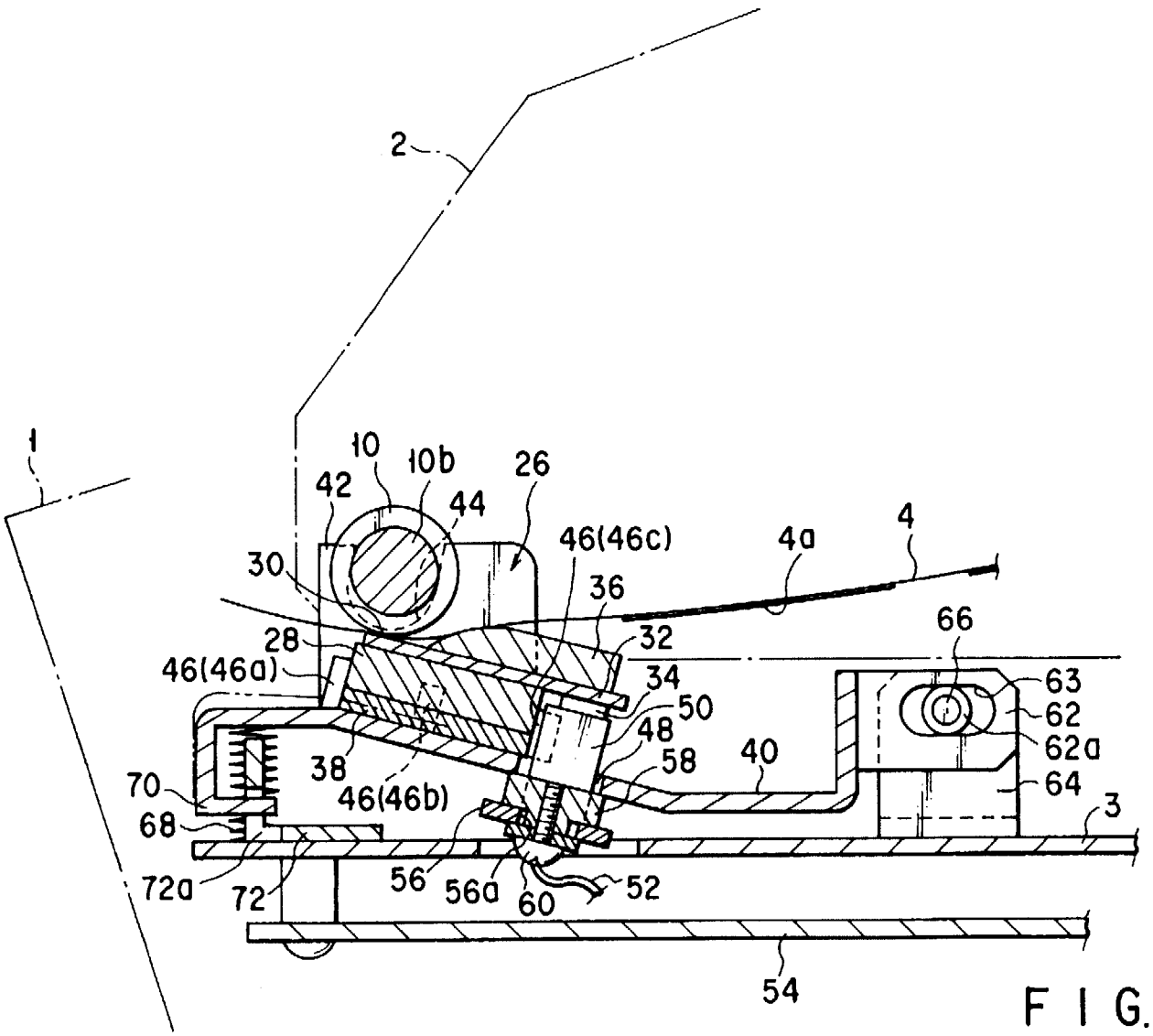
FIG. 4 is a partially enlarged cross sectional view with the cover closed.
Figure 5C:
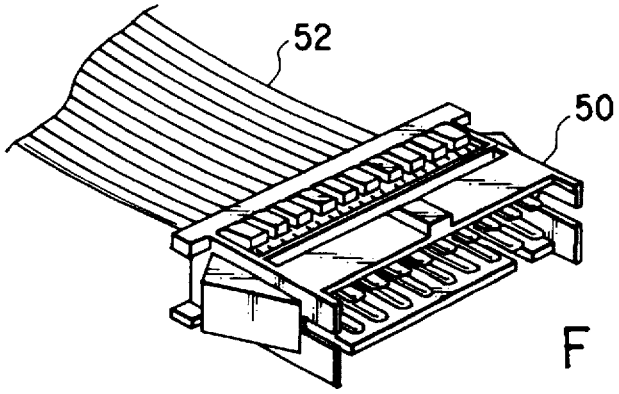
Figure 6:
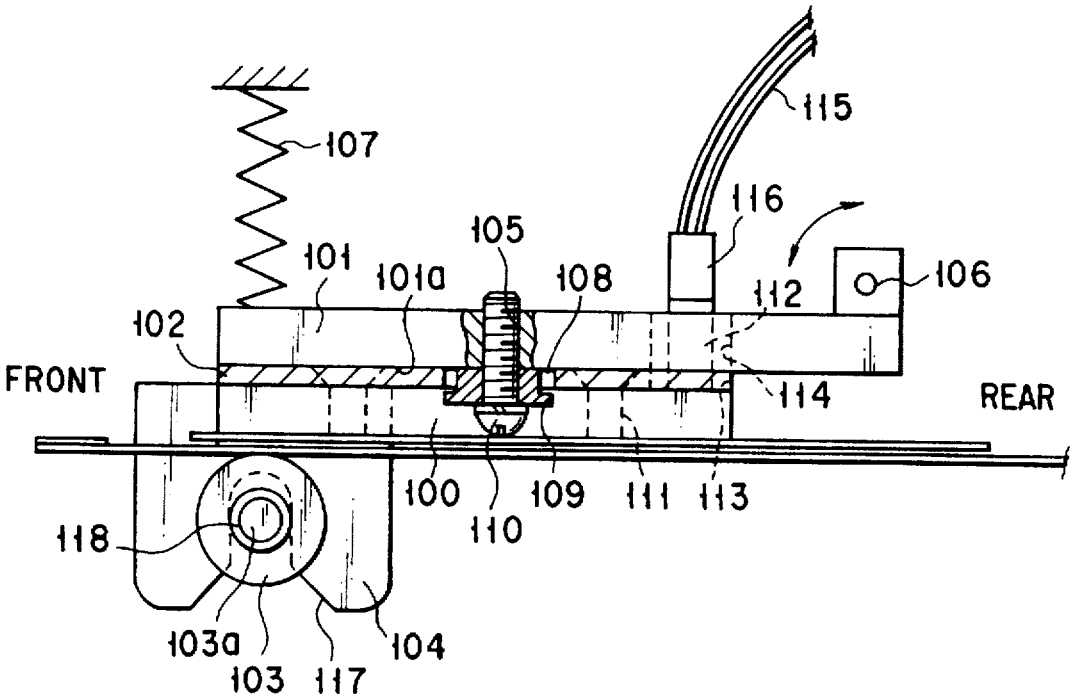
F I G. 6 (PRIOR ART)
FIG. 6 is a partially broken cross sectional view showing a part of a conventional thermal head supporting mechanism.

As shown in FIGS. 3, 5A, and 5C, the circuit side connector 50 is mounted to the back surface of the head frame 40 for connection to the head side connector 34.

The circuit side connector 50 is electrically connected by a lead line 52 such as a cable to a circuit board 54 fixedly mounted on the back side of the base frame 3.

The length and width of the circuit side connector 50 is smaller than the size of the opening 48 of the head frame 40 for insertion in the opening 48 and mounted at both, left and right, ends to a rectangular mounting plate 56 by retaining means 60 such as screws with stepped disk collars 58.

The mounting plate 56 has two mounting apertures 56*a* provided therein at both, left and right, ends.

The stepped collar 58 comprises a radially enlarged region 58*a* and a radially reduced region 58*b* formed integrally and coaxially. The diameter A of the radially enlarged region 58*a* is greater than the width H1 of the opening 48 of the head frame 40, and the diameter B of the radially reduced region 58*b* is smaller than the diameter C of the mounting aperture 56*a* in the mounting plate 56.

The circuit side connector 50, when mounted through the opening 48, extends a distance upwardly from the surface of the head frame 40 and is allowed to displace to and from the head frame 40 for fine adjustment.

As the circuit side connector 50 is arranged to be slightly movable to and from the head frame 40, it can offset intrinsic incorrectness of the connector 34 or 50 and compensate a change in the location of the base 28 which acts as a reference for positioning the thermal head 26 to the head frame 40.

An L shaped support 62 is provided integrally on a rear center region of the head frame 40.

The L shaped support 62 has a horizontally extending slot 63 provided therein.

The L shaped support 62 is movably joined by a retaining means 66, such as a screw extending crosswisely in the slot 63, to a mounting angle member 64 of an L shape securely mounted on the base frame 3.

The distal end of the head frames 40 are secured at two, left and right, ends by the urging means or coil springs 68 to the base frame 3.

This allows the head frame 40 to turn and move about the support axis 62*a* of the L shaped support 62 in the four, upper, lower, front, and rear directions in relation to the base frame 3.

The head frame 40 remains urged upwardly by the urging means 68 for turning about the support axis 62*a* of the support 62.

When the cover 2 is closed, the urging means 68 press the heating element 30*a* of the thermal head 26 located in position on the head frame 40 against the periphery of the platen 10 nipping the label tape 4 between the heating element 30*a* and the platen 10.

Hence, the thermal head 26 is urged by a desired pressure against the platen 10.

The stopper 70 is formed integral with the head frame 40 by bending a center distal portion of the head frame 40 upwardly to a channel shape.

The stopper 70 is engaged in a horizontally extending cutout 72*a* provided in the opposite stopper 72 of an L shaped angle number fixedly mounted on a distal center region of the base frame 3. When the cover is opened, the stopper 70 comes into contact with an upper end of the cutout 72*a* of the angle member 72 thus restricting and preventing the head frame 40 from being lifted by the urging force of the urging means 68.

Prior to starting the printing on the labels 4*a*, the thermal head 26 is positioned on the head frame 40.

More specifically, the thermal head 26 is lowered from above to the mount surface 40*a* of the head frame 40 so that the four sides 28*a*, 28*b*, 28*c*, and 28*d* of its base 28 come into direct contact with the inner walls of the corresponding projections 46*a*, 46*b*, and 46*c* of the head frame 40.

Simultaneously, the magnetic member 38 bonded to the lower surface of the base 28 holds the head frame 40 by its attraction.

As the result, the thermal head 26 is securely positioned on the head frame 40 with the four sides 28*a*, 28*b*, 28*c*, and 28*d* of the base 28 closely engaged with the inner walls of the corresponding projections 46*a*, 46*b*, and 46*c* of the head frame 40, thus allowing no displacement in any of the left, right, front, and rear directions.

As the base 28 is located in relation to the head frame 40, its head side connector 34 is fitted into and surrounded by the circuit side connector 50.

Because the circuit connector 50 is mounted movably on the head frame 40 at more or less of freedom in the left, right, front, and rear directions, its connection to the head side connector 34 is guaranteed.

After the thermal head 26 is positioned to the head frame 40, the label tape 4 of the roll is loaded with its shaft 8 placed on the shaft support extensions 7 of the supports 5.

The leading end of the label tape 4 is fed out to the front end of the housing body 1 so that the labels 4*a* on the label tape 4 pass across the width of the heating element 30*a*, and then the cover 2 is closed.

The cover 2 is secured with its open/closing levers 18 engaged with the notches 20 of the housing body 1.

While the heating element 30*a* of the thermal head 26 is engaged with the platen 10 of which the bearings 10*b* are held in the notches 44 of the head frame 40, it is securely positioned under an appropriate pressure given by the urging means 68 with the label tape 4 interposed between the heating element 30*a* and the platen 10.

Upon activating the printing apparatus, the label tape 4 is advanced between the thermal head 26 and the platen 10 towards the front end of the housing body 1 and the printing of characters is made on its labels 4*a*.

When the thermal head 26 in the housing body 1 needs to be replaced with a new one after a considerable length of operating time for printing on a large number of the labels 4*a*, the cover 2 is opened by disengaging the open/closing levers 18 from the their respective notches 20 in the housing body 1 with the unshown operating bar.

Then, the thermal head 26 is upwardly pulled out and removed from the head frame 40.

As the thermal head 26 is lifted upward, the head side connector 34 departs from the circuit side connector 50.

A new thermal head 26 is then positioned and tightened in the prescribed manner.

As set forth above, the thermal printing apparatus of the present invention includes the positioning projections 46 (46*a*, 46*b*, and 46*c*) provided on the mount surface 40*a* of the head frame 40, which is installed to the base frame 3 in the housing body 1, for holding at left, right, front, and rear locations the base 28 of the thermal head 26, the positioning members 42 provided on both ends of the head frame 40 for locating the platen 10 when the cover 2 is closed, and the circuit side connector 50 movably mounted across the mount surface 40*a* for connecting to the head side connector 34 of the thermal head 26 with a proper positional adjustment. Accordingly, the thermal head 26 is installed with no retaining screws, can be mounted and dismounted without the use of any conventional tool such as a screwdriver, and can be positioned with accuracy.

Also, the thermal printing apparatus of the present invention allows the two connectors 34 and 50 to be connected and disconnected upon mounting and dismounting of the thermal head 26. Accordingly, it is not necessary to draw out the circuit side connector 50 with its lead line 52 from the housing body 1 during the dismounting of the thermal head 26.

This permits the thermal printing apparatus of the present invention to provide ease of the handling of the lead line 52 without requiring a considerable size of space for installation of the lead line 52 and with less chance of tangling and damaging to other components during the mounting and dismounting of the thermal head 26, and thus increase its operating efficiency is increased.

Since the thermal head 26 in the thermal printing apparatus of the present invention is easily mounted and dismounted by hand on the head frame 40 with the two connectors 34 and 50 connected and disconnected respectively at the time, substantial jobs including the inspection and maintenance service of the apparatus can be performed with much ease.

In the thermal printing apparatus of the present invention, the head frame 40 on which the thermal head 26 is installed is pivotably secured at one end to the base frame 3 in the housing body 1 with its pivot slightly movable for adjustment and remains urged at the other end by the urging means 68. As the head frame 40 is movable at a given degree of freedom in the left, right, front, and rear directions on the base frame 3, the positional relationship between the thermal head 26 and the platen 10 is maintained constantly through aligning the printing position of the thermal head 26 with the normal extending across the thermal head 26 and the platen 10 even if the printing position has been dislocated by vibration during the operation. Also, while the cover 2 is closed, the thermal head 26 remains evenly urged against the platen 10 by the yielding force of the urging means 68 thus performing an accurate printing action.

In the thermal printing apparatus of the present invention, the thermal head 26 is urged against the mount surface 40*a* of the head frame 40 by the attraction of the magnetic member 38 in addition to the mechanical connection between the two connectors 34 and 50. Accordingly, the attachment of the thermal head 26 to the head frame 40 is enhanced thus preventing the thermal head 26 from removing off from the head frame 40 when the cover 2 is being opened.

Furthermore, the circuit side connector 50 to be coupled to the head side connector 34 of the thermal head 26 is mounted at a degree of freedom to the head frame 40 and can offset any variation of the base 28 which acts as the reference for positioning the thermal head 26 and the two connectors 34 and 50.

The present invention is not limited to the label printer of the above described embodiment but can be successfully applicable to any type of the thermal printing apparatus equipped with a thermal head.

Although the embodiment includes the platen 10 mounted in the cover 2 and the head frame 40, on which the thermal head 26 is located, mounted in the housing body 1, a reverse arrangement can be employed with equal success in which the platen 10 and the head frame 40 are changed over.

In the latter case, the head frame 40 is pivotably mounted at one end to the cover frame 9 in the cover 2 for adjustment in the center and at the other end urged by the urging means 68 while the platen is installed in the housing body 1.

The thermal printing apparatus of the present invention allows the thermal head to be positioned and secured without using conventional retaining screws. Accordingly, the mounting, dismounting, and positioning of the thermal head can be carried out without the use of a common tool such as a screwdriver in synchronism with the connection and disconnection of a pair of the connectors. Also, it is unnecessary to draw out the circuit connector with its lead line from the housing body during the mounting and dismounting of the thermal head, whereby no troublesome handling of the lead line is required and the operating efficiency of the thermal printing apparatus will be increased.

Also, the thermal printing apparatus of the present invention includes the magnetic member of which attraction is used for attaching the thermal head to the thermal head mount in addition to the mechanical connection between the two connectors. Accordingly, the thermal head is securely positioned on the surface of the thermal head mount and will hardly be removed off when the housing is opened.

Furthermore, the thermal printing apparatus of the present invention permits the thermal head mount to be pivotably mounted at one end to the first shell of the housing and at the other end urged by the urging means so that the thermal mount is movable at a certain degree of freedom in any of the left, right, front, and rear directions. Accordingly, if displacement of the thermal head is caused by vibration during the operation, it can be offset by aligning the printing position of the thermal head with the normal extending from the thermal head to the platen. The thermal head is constantly positioned in relation to the platen as evenly urged against the platen, thus ensuring a highly accurate printing action.

Additional embodiments of the present invention will be apparent to those skilled in the art from consideration of the specification and practice of the present invention disclosed herein. It is intended that the specification and examples be considered as exemplary only, with the true scope of the present invention being indicated by the following claims.

What is claimed is:

1. A thermal head printing apparatus comprising;

a main shell;

a frame arranged to be movable in first and second directions for opening and closing the main shell;

a thermal head including a strip-like heating element for printing on a printing medium, a circuit board having a circuit for driving the heating element, a head-side connector connected to the circuit board, and a rectangular base supporting the heating element and the circuit board, wherein:

(a) the rectangular base is formed of a metallic material having radiation characteristics, and has an upper surface which supports the heating element and the circuit board, a bottom surface which releases heat generated by the heating element when the thermal head is attached, and front, rear, right and left side surfaces which are provided as reference surfaces for use in correctly positioning the thermal head when the thermal head is attached to the thermal printing apparatus, (b) the circuit board includes a portion which is projected backwards from a rear region of the upper surface of the rectangular base, (c) the heating element is formed on the upper surface of the rectangular base along a longitudinal direction of the rectangular base so as to have a predetermined relationship with the rectangular base, and (d) the head-side connector is provided on a bottom of the projected backwards portion of the circuit board such that the head-side connector is movable for connection and disconnection in a direction perpendicular to the bottom surface of the rectangular base;

a platen pivotally mounted to the frame for nipping the printing medium between the platen and the heating element of the thermal head when the frame is moved so as to close the main shell;

first positioning means provided on the frame coaxially with respect to the platen; and a thermal head mount, formed of a metallic material having radiation characteristics, for detachably supporting the thermal head so that the heating element faces upwards, and for causing the platen and the heating element to be correctly positioned when the frame is moved so as to close the main shell, wherein the thermal head mount is provided in the main shell such that the thermal head mount is movable forwards and backwards relative to the main shell, and wherein the thermal head mount includes:

(a) a mount surface which is provided such that the bottom surface of the rectangular base is brought into contact with the mount surface when the thermal head is attached, and which allows heat generated from the heating element to be transmitted to the mount surface when the thermal head is attached;

(b) at least four projections which are projected upwards from the mount surface, and which allow the front, rear, right and left side surfaces of the rectangular base to be respectively brought into contact with the at least four projections when the thermal head is attached, whereby the thermal head is correctly positioned by the at least four projections and the mount surface;

(c) second positioning means which is engaged with the first positioning means to thereby position the platen and the thermal head when the frame is closed to cover the main shell; and (d) a circuit-side connector, provided opposite to the head-side connector and in a rear region of the mount surface, for being connected to and disconnected from the head-side conductor in a direction perpendicular to the mount surface, and for holding the thermal head attached to the thermal head mount in cooperation with the head-side connector when the thermal head is moved in the direction perpendicular to the mount surface to be attached to the thermal head mount;

wherein when the head-side connector is moved to be disconnected from the circuit-side connector in the direction perpendicular to the mount surface, the thermal head is detached from the thermal head mount.

2. A thermal printing apparatus according to claim 1, wherein the thermal head further comprises a magnetic member provided on the bottom surface of the rectangular base for causing the magnetic member and the mount surface of the thermal head mount to be magnetically attracted to each other to thereby fix the thermal head to the thermal head mount.

3. A thermal printing apparatus according to claim 1, wherein the circuit-side connector is provided on the thermal head mount such that the circuit-side connector is slightly movable forwards, backwards, rightwards and leftwards relative to the thermal head mount.

4. A thermal printing apparatus according to claim 1, wherein the frame is supported within a cover rotatable to open and close the main shell.

5. A thermal printing apparatus according to claim 1, wherein the thermal head mount has a first end which includes a center portion supported by a shaft, and a second end having urging members at both end portions thereof for urging the heating element against the platen, and wherein the thermal printing apparatus further comprises a stopper member provided between the thermal head mount and the main shell for restricting a movement of the thermal head mount to the platen which is caused by urging forces of the urging members when the frame is closed to cover the main shell.

6. A thermal printing apparatus according to claim 1, wherein the main shell includes a storage portion, provided rearwards of the thermal head mount, for receiving a printing medium wound in a roll shape.

7. A thermal printing apparatus according to claim 6, wherein the printing medium comprises a plurality of labels which are adhered to a label base mount wound in the roll shape such that the labels are spaced at a constant pitch.

8. A thermal printing apparatus comprising:

a main shell;

a frame arranged to be movable in first and second directions for opening and closing the main shell;

a thermal head for printing on a printing medium, the thermal head including:

(a) a heat radiator plate;

(b) a printed circuit board mounted on an upper surface of the head radiator plate;

(c) a heating element mounted on an upper surface of the printed circuit board and located at a position having a predetermined relationship to the heat radiator plate; and (d) a first connector provided on the printed circuit board with vertical connecting directions;

a platen pivotably mounted to the frame for nipping the printing medium between the platen and the thermal head;

first positioning means provided on the frame coaxially with respect to the platen;

a thermal head mount having second positioning means for laterally positioning the heat radiator plate and third positioning means arranged to be laterally movable with respect to the main shell for fixing a horizontal position of the thermal head while engaging with the first positioning means when the frame is moved in the second direction to close the main shell, thereby detachably supporting the thermal head; and a second connector mounted on the thermal head mount for detachably connecting to the first connector in the vertical connecting directions when the thermal head is installed on the thermal head mount;

wherein the thermal head further comprises a magnetic member mounted to a bottom of the heat radiator plate for attaching the thermal head to the thermal head mount by magnetic attraction.

9. A thermal printing apparatus according to claim 8, wherein the second connector is movably mounted to the thermal head mount for fine lateral positional adjustment.

10. A thermal printing apparatus according to claim 8, wherein the frame is supported by a cover movable for opening and closing the main shell.

11. A thermal printing apparatus according to claim 8, wherein the thermal head mount is pivotably mounted at a first end to the main shell for positional adjustment at a center Portion, and is urged at both end portions of a second end by urging means so that the heating element is pressed against the platen, and wherein stoppers are provided between the thermal head mount and the main shell for restricting a movement of the thermal head mount towards the platen caused by a yielding force of the urging means when the frame is opened.

12. A thermal printing apparatus according to claim 8, wherein the main shell includes a container mounted therein behind the thermal head mount for accommodating a roll of the printing medium.

13. A thermal printing apparatus according to claim 12, wherein the roll of the printing medium comprises a roll of base tape on which a plurality of labels are attached at equal intervals of a predetermined distance.

14. A thermal printing apparatus comprising:

a housing including first and second shells joined to each other at respective ends for opening and closing the housing;

a platen pivotably mounted to the second shell;

a thermal head including a heating element, mounted on a first side of a rectangular bases for printing on a printing medium, and a head side connector having connecting directions perpendicular to a plane on which the heating element is mounted;

positioning members for determining a position of the platen when the housing is closed;

a thermal head mount movably mounted to the first shell and having positioning projections for coming into direct contact with four sides of the rectangular base to hold the thermal head in position; and a circuit side connector movably mounted to the thermal head mount for fine positional adjustment in relation to the head side connector of the thermal head;

wherein the rectangular base includes a magnetic member, mounted to a second side of the rectangular base opposite to the first side on which the heating element is mounted, for magnetically attracting the first shell for attachment thereto.

15. A thermal printing apparatus according to claim 14, wherein the thermal head mount is pivotably mounted at a first end to the first shell for positional adjustment at a center portion, and is urged at both end portions of a second end by urging means so that the heating element is pressed against the platen, and wherein stoppers are provided between the thermal head mount and the first shell for restricting a movement of the thermal head mount towards the platen caused by a yielding force of the urging means when the housing is opened.

* * * * *